US006866202B2

(12) United States Patent
Sigafus et al.

(10) Patent No.: US 6,866,202 B2
(45) Date of Patent: Mar. 15, 2005

(54) VARIABLE OUTPUT HEATING AND COOLING CONTROL

(75) Inventors: Paul E. Sigafus, Medina, MN (US); Ralph H. Torborg, Big Lake, MN (US); James W. Ratz, Bloomington, MN (US); Larry L. Lutton, Burnsville, MN (US)

(73) Assignee: Varidigm Corporation, Plymouth, MN (US)

( * ) Notice: Subject to any disclaimer, the term of this patent is extended or adjusted under 35 U.S.C. 154(b) by 71 days.

(21) Appl. No.: 10/236,678

(22) Filed: Sep. 6, 2002

(65) Prior Publication Data

US 2003/0059730 A1 Mar. 27, 2003

Related U.S. Application Data

(60) Provisional application No. 60/322,133, filed on Sep. 10, 2001.

(51) Int. Cl.[7] ..... F23N 5/00

(52) U.S. Cl. ..... 236/11; 236/15 BD; 236/78 D; 431/12

(58) Field of Search ..... 236/11, 15 BD, 236/46 R, 46 F, 78 D; 431/12, 90

(56) References Cited

U.S. PATENT DOCUMENTS

| | | | | | |
|---|---|---|---|---|---|
| 3,294,146 | A | | 12/1966 | Voorheis | |
| 3,960,320 | A | * | 6/1976 | Slater | 236/15 BD |
| 4,817,705 | A | * | 4/1989 | Levine et al. | 236/46 R |
| 5,197,664 | A | | 3/1993 | Lynch | 236/11 |
| 5,248,083 | A | | 9/1993 | Adams et al. | 236/11 |
| 5,806,760 | A | | 9/1998 | Maiello | 236/11 |
| 5,865,611 | A | | 2/1999 | Maiello | 431/12 |
| 5,971,745 | A | * | 10/1999 | Bassett et al. | 431/12 |
| 5,997,278 | A | * | 12/1999 | Sutton | 431/12 |
| 6,247,919 | B1 | | 6/2001 | Welz, Jr. et al. | 431/13 |
| 6,282,910 | B1 | | 9/2001 | Helt | 62/229 |
| 6,329,783 | B1 | | 12/2001 | Vrionis et al. | 318/772 |
| 6,504,338 | B1 | | 1/2003 | Eichorn | 318/727 |
| 6,533,574 | B1 | * | 3/2003 | Pechoux | 431/90 |

FOREIGN PATENT DOCUMENTS

| | | | |
|---|---|---|---|
| DE | 43 34 625 | 4/1994 | F23N/3/00 |
| EP | 567 060 | 10/1993 | F23N/5/18 |
| JP | 03007826 | 1/1991 | F24F/5/00 |

* cited by examiner

*Primary Examiner*—Harry B. Tanner
(74) *Attorney, Agent, or Firm*—Pauley Petersen & Erickson

(57) ABSTRACT

A heating or cooling system, such as an HVAC system, of variable output has a number of control elements and may include a variable speed compressor, a variable speed combustion (induced or forced draft) blower motor; a variable speed circulator blower motor; a variable output gas valve or gas/air premix unit; and a controller specifically developed for variable output applications. The system may utilize a pressure sensor to determine the actual flow of combustion airflow in response to actual space conditions, vary the speed of the inducer blower, and subsequently vary the gas valve output to supply the correct amount of gas to the burner system. A temperature sensor may be located in the discharge air stream of the conditioned air to provide an input signal for the circulator blower.

9 Claims, 8 Drawing Sheets

VARIABLE OUTPUT HEATING AND COOLING CONTROL

This application claims the benefit of the filing date of U.S. Provisional Application Ser. No. 60/322,133 filed 10 Sep. 2001.

BACKGROUND OF THE INVENTION

1) Field of the Invention

The present invention relates generally to the control of systems for the heating or cooling of fluids, e.g., air or water. In particular, the present invention relates to provision of systems and techniques for variable operation of such systems.

2) Discussion of the Related Art

In the field of gas burner technology relating to burners such as may be used in furnaces, water heaters, boilers, and the like, it is desirable to control the operation of a burner beyond merely supplying gas and providing air for combustion at a fixed flow rate, and igniting the mixture. Numerous factors must be considered in the construction, placement and operating conditions for a gas burner.

Typically, variably controllable parts of a burner appliance may include the combustion fan also sometimes called the inducer fan, which creates a negative pressure in the combustion area to supply air to the combustion process and create draft to ensure removal of the products of combustion. Terminology in the art will sometimes distinguish a power burner which uses positive pressure, and an induced draft burner which uses negative pressure. A circulator fan may be used to variably control movement of the treated air, such as by blowing over the heat exchanger for the movement of heated air. "Fan", "motor" and "blower" may sometimes be used interchangeably herein in referring to motor driven fans for air movement. Variable fuel valves are known in the art which can modulate, or vary, the supply of fuel to a burner. "Appliance" will be used herein in the sense of a hardware device such as a burner or condenser for heating or cooling, or a larger apparatus such as a furnace or air conditioning unit using such a burner or condenser.

In general it is true that a burner which operates closely to stoichiometric conditions is more efficient than one which is operating, for example, with a large amount of excess air. If the amount of fuel gas and combustion air are known, the actual combustion conditions, relative to stoichiometry, may be defined.

Problems faced by gas burners include performance variations caused by changes in airflow, such as due to fan/blower degradation and flue blockage. Variations in burner performance caused by the aforementioned conditions may result in excessive pollutant production, which in turn may be a health and safety hazard. Some prior art appliances provide a fixed air supply to a burner, and must, therefore, supply enough air to prevent excessive production of deleterious gases such as carbon monoxide and oxides of nitrogen under ideal operating conditions, and also provide a safety margin to account for incidences such as a blocked stack or an overfire condition (i.e., a significant increase in the firing rate above the rated value) within the appliance. Therefore, a standard appliance is typically designed with an excess air level significantly higher than would be required if changes in firing rate or airflow could be compensated for automatically. The additional safety margin of excess air may result in a significant reduction in appliance efficiency. Accordingly, it would be desirable to more closely control the fuel to air ratio to achieve greater efficiency.

An additional problem that gas burner equipped appliances, such as furnaces, face, is the effect that altitude has upon performance. At higher altitudes, burners receive air that is less dense, and accordingly, has less oxygen. Accordingly, for appliances that are not capable of modifying their operation in response to altitude, such apparatus must be derated for altitudes that are different than a "base" or nominal optimum operating altitude (e.g., sea level). For example, it is typical to derate an appliance, such as a furnace, at a rate of −4% per every 1000 feet of increased altitude. That means that for an appliance having a rating of X BTU/Hr at sea level, the rating may be X*(1−0.04) BTU/Hr at 1000 feet.

Gas burning appliance designs are known in which the supplies of fuel gas, primary combustion air and secondary combustion air (if such is applied) are capable of being physically controlled in finite increments to facilitate safe and efficient operation. However, with prior designs, this is typically achieved through the use of complex mechanical systems, such as a mechanical jackshaft. Known appliances may have the capability to modulate or vary fuel flow over a wide supply range, thus providing a wide range of heating capacity (firing rates) through a single appliance. However the known variable systems are presently very expensive. Modulating fuel capabilities may greatly increase a system's overall efficiency. Two stage systems, i.e., systems capable of operating at two firing rate levels, are available, but are limited in their scope and range of operation due to their inability to precisely control the fuel gas and air mixture at two levels only, and the need for a wide excess-air safety margin.

As stated, a continuously modulating appliance, to be efficient, may require close control of the fuel/air ratio. Though it is possible to directly measure the fuel and airflow rates independently and thereby determine the fuel and air mixture, such a detection system would require expensive sensor systems and be complex and possibly overly costly for most appliance applications of interest. A known system as taught in U.S. Pat. No. 5,971,745 may therefore be used.

Various other techniques or systems to increase the efficiency of an air treatment system have been proposed. Variable speed motors for blowers, fans, etc., for air movement have been used to a limited degree but they, alone, do not allow the appliance to vary its output since other components must also be varied to safely modulate a combustion appliance. Further, most commercially available variable speed motors are expensive.

It is also generally true that the more modulation and control capability placed into an appliance system, the greater the cost to supply and maintain sensing and control of that system to achieve the desired efficiency increases. However, the applicants do not believe that a control system for integrating all factors of a variable heating or cooling system has yet been presented which takes full advantage of the efficiencies to be gained from such systems while providing variable control at a reasonable cost and performance level.

SUMMARY OF THE INVENTION

The present invention provides an inexpensive system for variable output fluid conditioning, e.g., heating or cooling, or both, equipment through the use of a series of electronically controllable variable output components and economical sensing and control systems. Economical implementation may further be achieved by the use of inexpensive variable speed motor technology as described in U.S. Pat.

No. 6,329,783 and patent application Ser. No. 10/191,975, for the control of shaded pole or standard permanent split capacitor (PSC) AC induction motors. U.S. Pat. No. 6,329,783 and patent application Ser. No. 10/191,975, are of common ownership herewith, and are incorporated herein by reference in their entirety.

In a typical variable output appliance according to the present invention, the system utilizes one or more variable speed motors, a variable output gas valve, and a controller that varies the controlled elements of the appliance to assure safe and efficient operation at all firing rates. While presented in exemplary form as a system for heating, ventilation, and air conditioning (HVAC) of air, the person having ordinary skill in the art will appreciate that aspects of the present invention may be applied to other fluid heating or cooling appliances or systems beyond these exemplary forms of the invention such as boilers, water heaters, IR heaters, cooking appliances, and the like.

Certain aspects of the present invention may employ a variable fuel supply gas valve, which may be stepped, or preferably, fully modulatable. Certain aspects of the present invention may employ a variable combustion-air supply such as a variable speed combustion fan, which likewise may be stepped or fully modulatable. Certain aspects of the present invention may employ both such variable components. Certain aspects of the present invention may employ variable components in the cooling function, such as stepped or modulatable compressors. Certain aspects of the present invention may further employ variable speed circulators, such as pumps for liquids or circulator fans for air, in conjunction with the other variable components.

In one aspect of the invention, an algorithm, sometimes herein called a "thermostat algorithm", of the controller may respond to a control signal call for appliance operation from any input/output sensing or control unit; such as from an On/Off thermostat, temperature sensor, boiler pressure sensor, analog control input, various proportional control devices, or the like; by determining a demand on the system such as an amount of fuel or fuel/air mixture, herein sometimes collectively referred to as a "firing rate", a rate of cooling compressor operation, or an amount of fluid circulation, from a variable, or modulatable, element controlling such conditions. For example, the controller may set a variable, or modulatable, fuel valve to the correct setting to deliver the desired amount of fuel. The thermostat algorithm may also determine a duty cycle, or time of operation, for the appliance. Based on the desired system demand from, e.g. the firing rate of, the appliance, the controller may determine the proper regulation of the various modulatable elements, e.g., the airflow required from the combustion blower such as by calculation or accessing a lookup table so as to achieve the correct stoichiometry. The speed of the combustion blower, or inducer, fan may be economically and reliably monitored by a differential pressure sensor and the variable speed motor of the combustion blower may be adjusted until the correct pressure (vacuum) is attained. The system may then trim, i.e. fine tune, the stoichiometry by adjusting the airflow, the gas flow, or a combination of both, by means of a closed loop system controlled by the pressure sensor, or further adjusted through a closed loop system as described in the aforementioned U.S. Pat. No. 5,971,745. When a different heating output is commanded, the speed of the combustion blower motor, as well as the electrically modulated gas valve, may be altered and then re-trimmed to achieve the correct stoichiometry at the new firing rate.

Various modulating, i.e. modulatable or variable, fuel valves may be used with aspects of the present invention. Two different types of modulating valves are discussed herein. A modulating pressure feedback valve may be used in applications where it is desirable that a gas valve be pneumatically linked to the combustion blower pressure (vacuum). In this case, the valve directly follows the blower pressure (vacuum) under all operating conditions. A modulating electronically operated valve may be used where it is desirable to apply a variable electronic input signal to the modulating valve.

Various types of burners, e.g., powered burners or induced draft in-shot burners or partial or fully pre-mixed burners, may be suitable for use with aspects of the present invention. In-shot burners are commonly used in most furnaces and small boilers, whereas pre-mix burners are increasingly common where superior emissions characteristics are desired.

A pressure sensor may be used with certain aspects of the present invention, e.g., to measure the differential pressure drop across the heat exchanger in order to determine the optimum characteristics of the combustion, or inducer, fan operation within the heat exchanger.

A variable speed circulator motor according to some aspects of the invention may be controlled through a wide speed range so as to maintain a desired discharge fluid temperature, pressure, or flow for the conditioned fluid, e.g., air. The basic control circuits are the subject of the previously mentioned U.S. Pat. No. 6,329,783 and co-pending patent application Ser. No. 60/304,954. To control the discharge air temperature to the conditioned space, a discharge air temperature sensor may be located downstream of the heat exchangers, e.g., either the furnace heat exchanger or the air conditioning coil, or both.

According to further aspects of the present invention, the controller responds to a thermostat and may operate an exemplary system in either of the heating or cooling modes. The controller may interface with the thermostat and limit controls and may perform all sequencing functions for operation of a fluid conditioning appliance while monitoring for operation safety at all times. The controller may operate the igniter, the variable speed combustion blower, the modulating gas valve and the variable speed circulator motor, and in some cases, the stoichiometry of the flame, e.g., in a Closed Loop Combustion Controller (CLCC) where required by the system. In addition, the controller may also operate the cooling compressor.

BRIEF DISCUSSION OF THE DRAWINGS

Exemplary embodiments of the invention are described below and are illustrated in the following Figures, which are to be used as aids to understanding the exemplary embodiments:

DESCRIPTION OF THE PRESENTLY PREFERRED EMBODIMENTS

Figure 1:
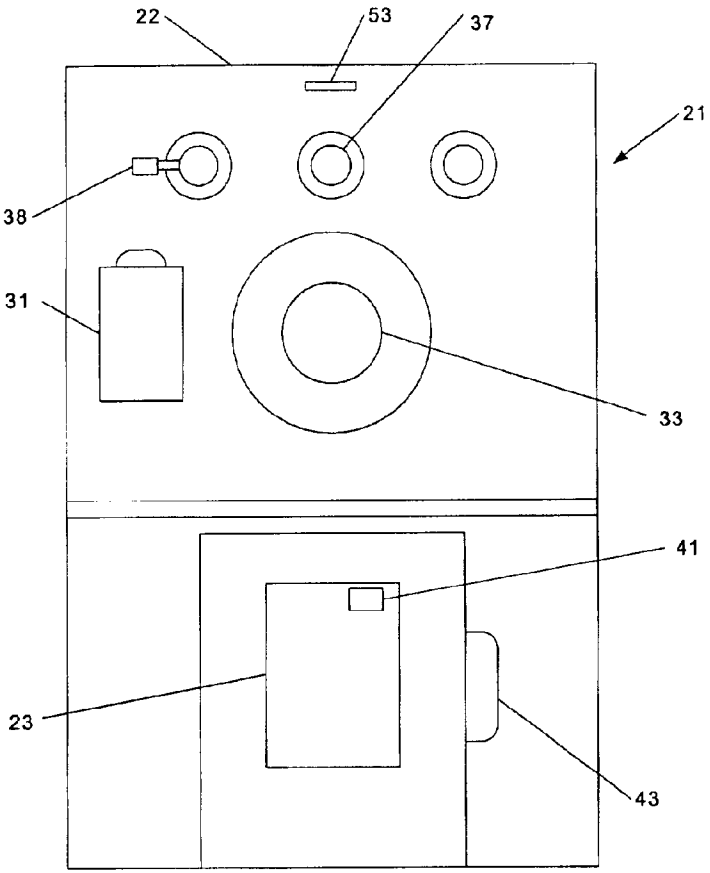
FIG. 1 shows a "Modulating Furnace" and identifies the key components
Figure 2:
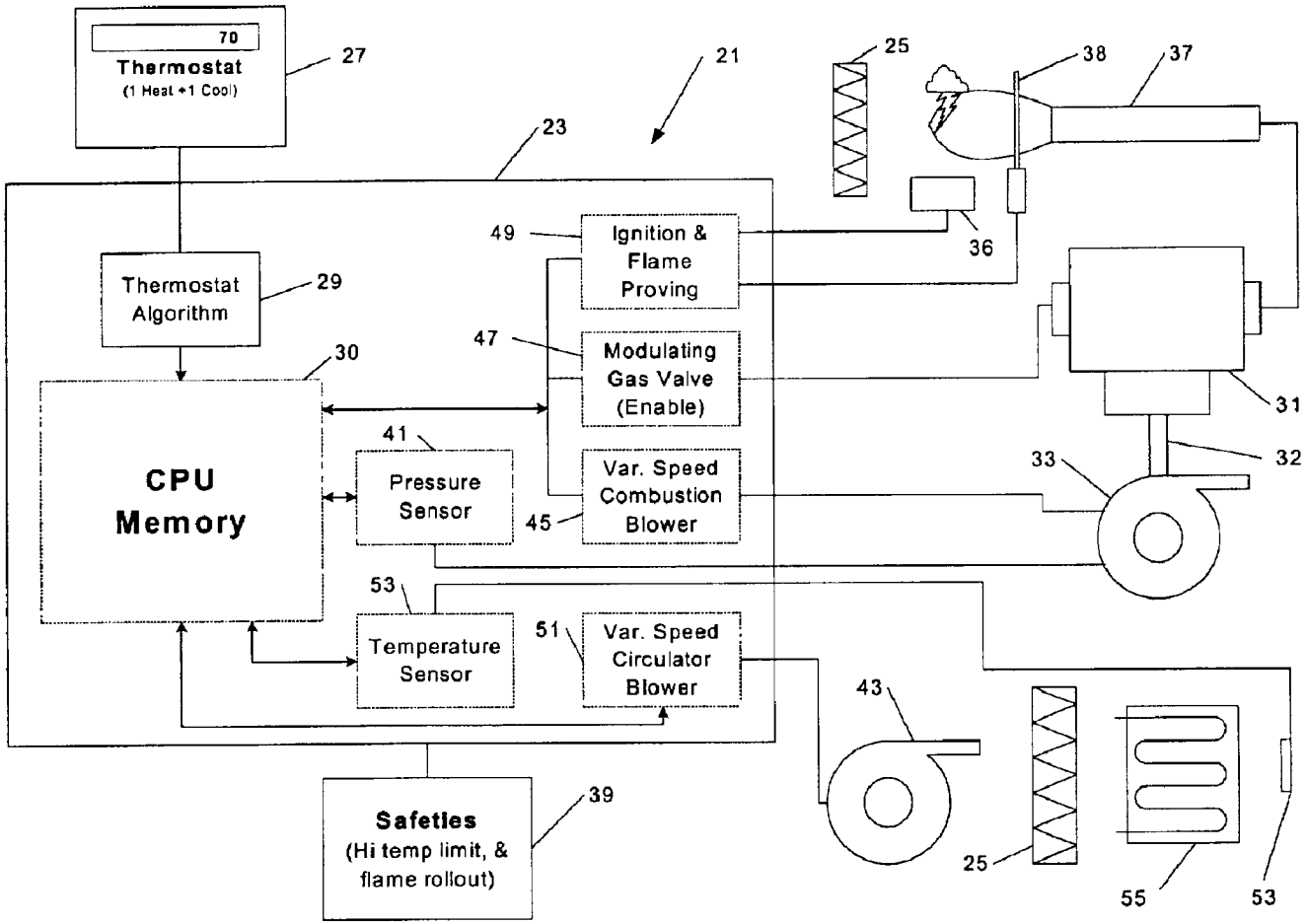
FIG. 2 is a schematic illustrating the basic architecture of a controlled system according to the present invention using a pressure feedback modulated valve.
Figure 3:
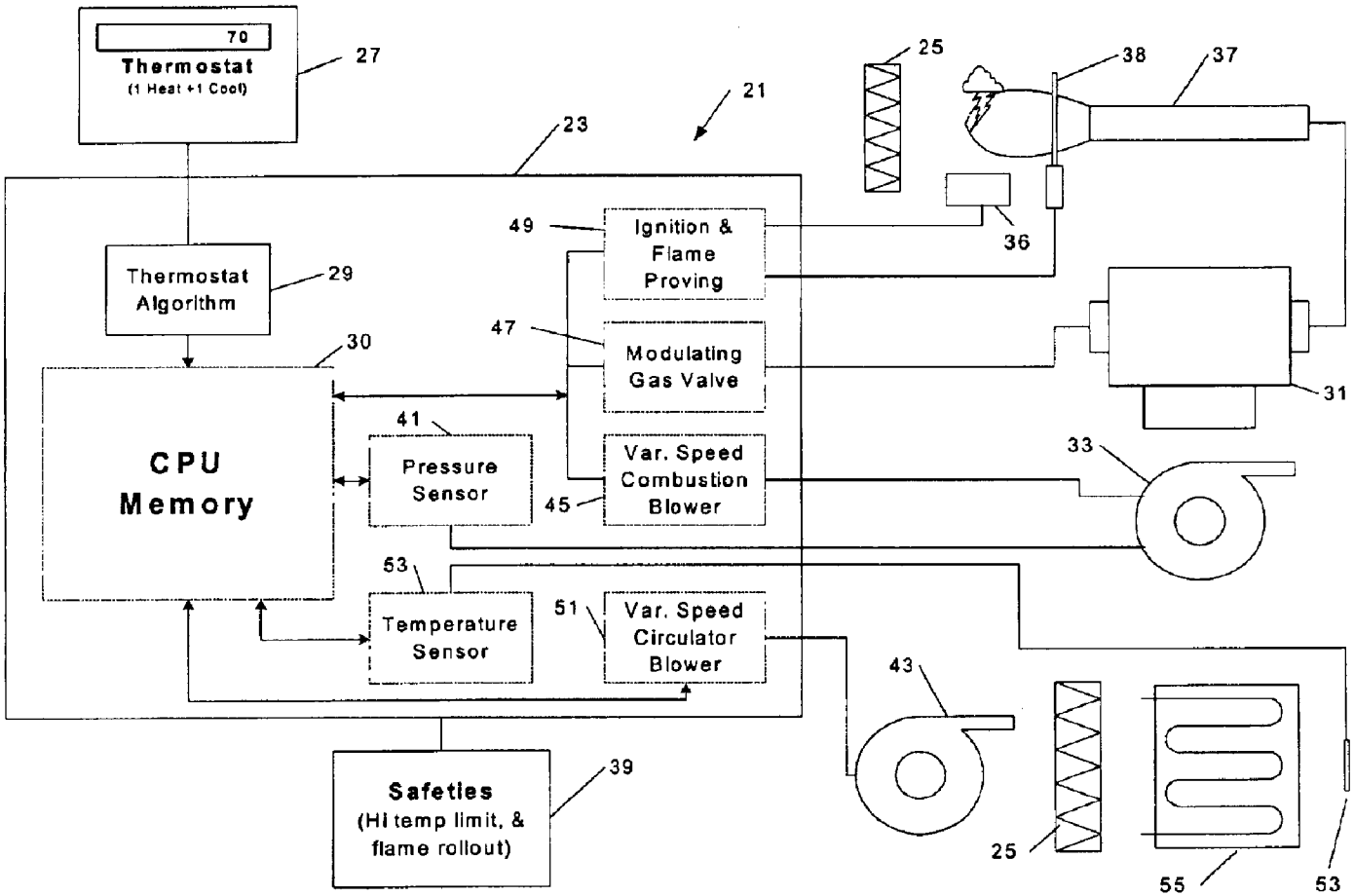
FIG. 3 is a schematic illustrating the basic architecture of a controller system according to the present invention using an electronically modulated valve.

Referencing FIGS. 1, 2 and 3, a heating or HVAC system 21 such as a furnace and circulation system, is shown as the exemplary embodiment of various aspects of an appliance according to the invention. FIG. 1 shows a pictographic representation of the key components of a variable, or modulating, furnace 22. FIG. 2 schematically illustrates a controller 23 in conjunction with the modulating furnace key components. Major components of the heating system 21 include a controller 23 and a heat exchanger portion 25, as will be understood by those persons having ordinary skill in the art. The controller 23 may receive, a call for operation of the appliance, in this case to produce heat, from a sensing element, such as a simple On/Off thermostat 27. A thermostat algorithm 29 residing in the controller 23 may then determine the firing rate required of the variable, or modulating, fuel valve 31 or the airflow required from the motor of the variable speed combustion blower 33, or both, in order to efficiently operate the burner 37, as further discussed below.

The input signal to an electronically modulated fuel valve 31 (FIG. 3) may be set in accordance with an appropriate lookup table value, or it may be calculated via memory and/or arithmetic components of the controller 23 represented by block 30. The speed of the combustion blower motor 33 may be adjusted until the correct pressure (vacuum) is attained indicating correct air flow so as to achieve the correct fuel/air stoichiometry. The controller 23 may then further trim the stoichiometry by adjusting the airflow, the gas flow, or a combination of both, through the output of combustion blower and gas valve drivers 45 and 47, respectively, as further explained below.

The controller 23, in addition to control of the variable combustion blower 33 and modulating fuel valve 31, may provide control of a variable speed circulator motor 43 through circulator blower driver 51. Feedback control of the variable speed circulator motor 43 may be achieved through input from a temperature sensor 53 or via control algorithms for constant air flow or pressure, as further detailed below.

The controller 23, in addition may perform the following functions of the exemplary air treatment system, including: controlling sequencing of the furnace operation, safe start checks, safety routines and monitoring of limit controls 39; controlling an igniter 36; monitoring a flame sensor 38 through an ignition and flame proving driver 49, providing and/or monitoring a pressure (vacuum) sensor 41 that is used for controlling firing rate; controlling the cooling compressor (not shown), and controlling accessory controls such as electronic air cleaners and the like (not shown), in order to maintain optimum space temperatures.

Modulating, or variable, gas valves may be used with aspects of the present invention. Two different types of modulating valves are discussed herein. A modulating pressure feedback valve as seen in FIG. 2 may be used in applications where it is desirable that the gas valve be pneumatically linked to the combustion blower pressure (vacuum). A separate pneumatic input 32 (either positive pressure or vacuum) to the valve 31 is the basis for modulating the gas output. The gas output is proportional to the pressure (vacuum) applied to the input section of the valve 31. The valve then follows the combustion fan, or inducer, pressure (vacuum) under all operating conditions. Thus its output is proportional to the pressure of the variable speed inducer blower and its adjustment may be controlled by modulation of the variable speed inducer blower.

A modulating electronically operated valve as seen in FIG. 3 may be used where it is desirable to apply a variable electronic input signal to the modulating valve. This valve may utilize either an analog or digital input signal. In both cases the valves may be modulated through a wide output range. Variable fuel/air supply burner systems, e.g., a partially pre-mixed burner implementation described below, may allow operation of a fully modulated burner using any of the methods of modulation described below.

Figure 4:
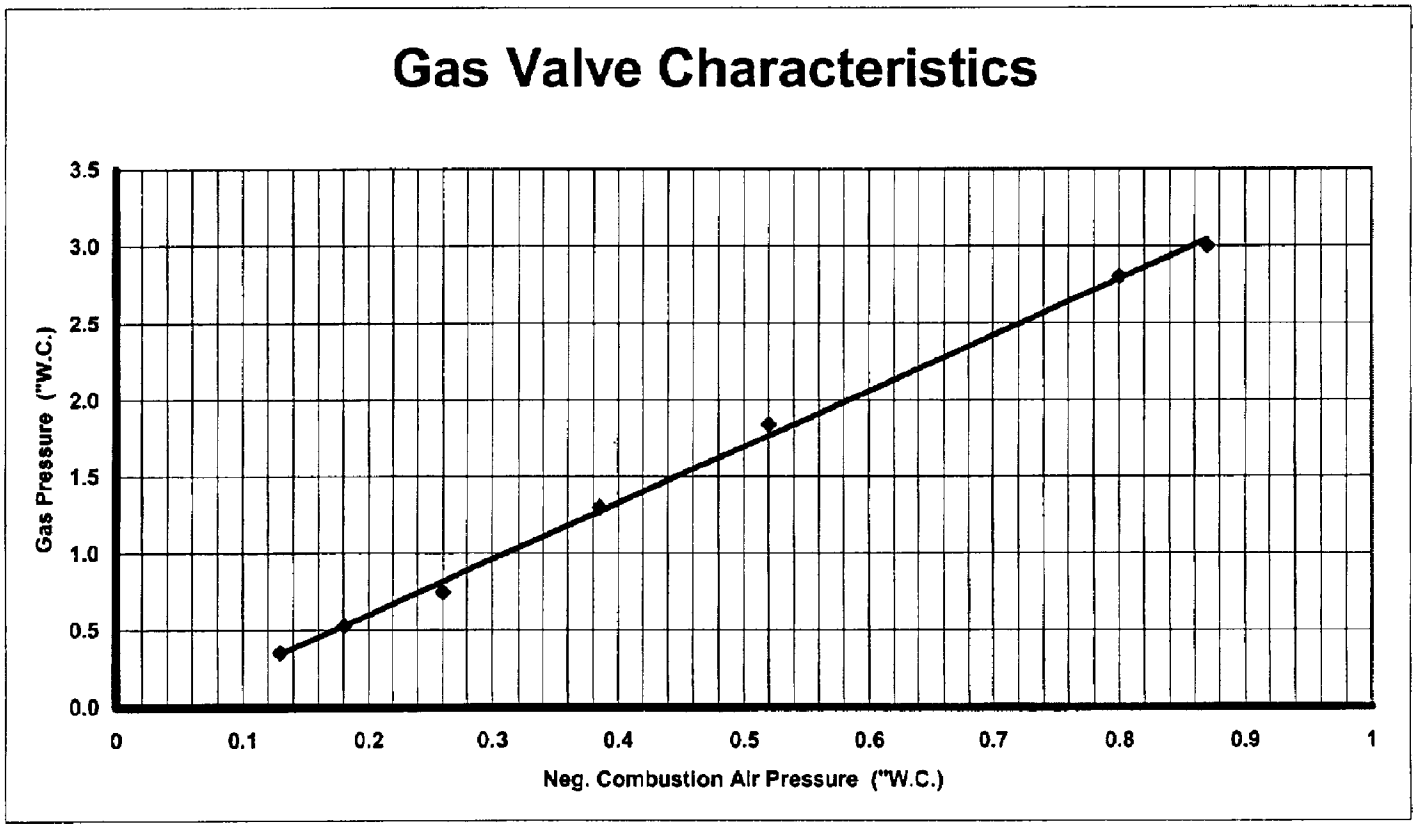
FIG. 4 shows performance data related to the modulating pressure feedback valve.

FIG. 4 shows the performance of the pressure feedback valve in an actual application. A bias may be incorporated into the valve such that the gas flow may not commence until the air pressure (vacuum) exceeds a specified value. This feature assures that the gas valve may not turn on until airflow has been proven at the specified level. A representative version of this gas valve may be obtained from The SIT Group under the commercial designation 828 Novamix.

The electrically modulating valve of FIG. 3, on the other hand, is more inexpensive and permits finer tuning when used in conjunction with self-calibrating systems such as the Closed Loop Combustion Controller using stoichiometric (fuel/air) control. This valve utilizes multiple electrical actuators to control gas flow. One or more (redundant) actuators are used to assure that the flow is either On or Off. A separate electrical actuator is generally used to modulate the gas flow. This modulating actuator is provided with an appropriate input signal that is proportional to the desired gas flow. The relationship between desired air and gas flow to assure proper stoichiometry is well known, hence a lookup table or equation may easily be developed and incorporated into the controller. A representative version of this gas valve may be obtained from White-Rodgers Div. of Emerson Electric Co. under the commercial designation 36E27 Modulating Electronic Governor.

Pneumatic Tracking System

A pressure sensor is used as a means of providing feedback loop control of the induced draft blower 33. The motor speed is automatically increased or decreased until the desired pressure is achieved. The pressure sensor 41 measures the differential pressure between a reference point (usually atmospheric) and the discharge side of the heat exchanger of the heating appliance. Flow may be defined by the following equation:

$$\text{Flow}=\text{Constant}*\text{Area}*\sqrt{\text{Pressure}}, \text{ or,}$$

Flow is equal to a constant (C) times the effective area (A equiv) of the heat exchanger section times the square root of the pressure drop ($P^{1/2}$) across that same restriction.

The pressure sensor 41, when used in this manner, is able to measure the combustion mass airflow and also compensate for air side variations such as varying vent lengths, flow blockages, altitude, etc. A representative version of such a pressure sensor may be obtained from Honeywell Inc. under the commercial designation CPXL/CPX or CPCL/CPC Micromachined Silicon Pressure sensors.

Thus, through a pressure feedback loop, the combustion blower pressure may be constantly monitored and the speed adjusted to attain the desired pressure because the appliance behaves like a fixed area (e.g. an orifice) which, when multiplied by the (square root of) differential pressure between the entry and exit points and a suitable constant, represents flow. Thus the variable speed combustion blower motor 33 may be controlled to achieve the correct speed for the desired firing rate.

One preferred variable speed combustion blower motor and an appropriate control operation for the motor are the subjects of U.S. Pat. No. 6,329,783 and co-pending patent application Ser. No 10/191,575, both disclosures of which are herein incorporated by reference. The variable speed motors of the present invention may be controlled according to those teachings inexpensively and efficiently through a wide speed range in order to provide the correct airflow for the combustion process.

Lightly loaded AC induction motors may closely approach synchronous speed throughout a wide range of voltage input levels. In variable speed applications it is desirable to be able to set the speed regardless of the load requirements. For example, to further control AC induction motors, speed may be sensed by turning off the entire motor very briefly and measuring the duration between two subsequent zero crossings of the decaying generated voltage signal. The motor would be turned off for perhaps two cycles while the speed is determined. Frequency measurement is somewhat simpler to achieve than amplitude measurement using back EMF from the powered windings. This circuit was described in co-pending U.S. patent application Ser. No. 10/191,975.

Rather than using a more costly modulating thermostat, aspects of the present invention provide a software based thermostat algorithm 29, or routine, which translates the incoming On-Off thermostat signal into an output signal that is proportional to the system demand. The thermostat algorithm function may monitor the thermostat on/off state, elapsed time, and present and previous duty cycle, or half cycle, times. The controller 23 uses this thermostat algorithm 29 to increase or decrease the firing rate, i.e. the amount of gas supplied, directly for the electronically modulating valve and indirectly for the pressure feedback valve, for the next combustion cycle. Duty cycle, or on time, of the gas supply and speed, i.e. air movement, desired from the inducer blower 33 may also be determined by the algorithm.

The thermostat algorithm 29 generally determines the commanded firing rate (CFR) of the furnace based on the thermostat duty cycle (TDC) and the previous firing rate (PFR) of the furnace.

The thermostat algorithm 29 of the exemplary embodiment is designed to achieve at least the following objectives: to adjust the commanded firing rate to achieve a 50% duty cycle of the thermostat; i.e. having the furnace output control the thermostat, instead of having the thermostat control the furnace output (as is normal); to extend the duty cycle of the burner to 100%; to use the previous firing rate (PFR) and most recent thermostat duty cycle information (ON %) to adjust the firing rate; and to establish a minimum "ON" time to reduce condensation in the appliance.

It will be noted that the commanded firing rates are computed as a percent with 0% representing OFF, 1% representing Low Fire (LF), and 100% representing High Fire (HF). Note that this firing rate scale is different from the more normal firing rate parameters that are expressed in percent of maximum BTUs rated for the appliance (i.e., the present value is using percent of fuel valve adjustment, or what the fuel valve can deliver, rather than a percentage of rated BTU's for the appliance). Note also that in the case of the pressure feedback type modulating valve, the system is actually adjusting, or commanding the inducer air flow in order that the valve may track that pressure (vacuum).

Thermostat Algorithm

1. The CFR will be calculated from the PFR and most recent $T_{ON}$ & $T_{OFF}$ times at each thermostat transition (i.e. each half cycle).
2. The firing rate will be adjusted to RATE_WARMUP (50% FR) for the first BURNER_TIME_IN_WARMUP seconds (60 sec.) following light-off.
3. If either $T_{ON}$ or $T_{OFF}$ are unknown (or of no practical value), the CFR will be set to RATE_WARMUP (50%).
4. Else if high fire was reached in the last ON half cycle, CFR=PFR+DEMAND_LIMIT_PERCENT (17% after HF or LF is reached).
5. Else if low fire was reached in the last ON half cycle, CFR=PFR−DEMAND_LIMIT_PERCENT.
6. Else (if neither high fire nor low fire was reached) CFR=PFR+DEMAND_UPDATE_PERCENT (3% maximum update per ON/OFF transition) $*(T_{ON}-T_{OFF})/(T_{ON}+T_{OFF})$.
7. The Firing rate will be set to CPR−AIR_OFF_DELTA_PERCENT (30%) when the STAT (thermostat) is OFF.

TABLE 1

| TDC | STAT | CURRENT FIRING RATE | TIMED EVENTS* |
|---|---|---|---|
| unknown | ON | RATE_WARMUP (50%) | $T_{ONRT}$ > 6 min => increase CFR 15% per minute to 100% |
| unknown | OFF | PFR − AIR_OFF_DELTA_PERCENT (30%) | $T_{OFFRT}$ > 6 min => decrease CFR 15% per minute to 0% |
| known | ON | PFR + DEMAND_UPDATE_PERCENT (3%) * $(T_{ON} - T_{OFF})/(T_{ON} + T_{OFF})$ | $T_{ONRT}$ > 6 min => increase CFR 15% per minute to 100% |
| known | OFF | PFR + DEMAND_UPDATE_PERCENT (3%) * $(T_{ON} - T_{OFF})/(T_{ON} + T_{OFF})$ − AIR_OFF_DELTA_PERCENT (30%) | $T_{OFFRT}$ > 6 min => decrease CFR 15% per minute to 0% |

*note:
sub RT is in reference to "real time", i.e. in running, not a recorded elapsed time Conditions The firing rates will be limited to the rang AIR_MIN_STAT_ON (50% FR)−AIR_MAX_STAT_ON (80% FR) when the STAT is ON.

The firing rates will be limited to the range of AIR_MIN_STAT_OFF (40% FR)−AIR_MAX_STAT_OFF (60%FR) when the STAT is OFF.

The Firing rate will be maintained at the CFR until BURNER_TIME_IN_SAME_RATE.

The Firing rate will then be adjusted up/down if the STAT is ON/OFF at a rate of 15% per minute.

The circulator blower speed will be adjusted to maintain a plenum temperature of 120–140° F.

For the exemplary HVAC embodiment the presently preferred values for the thermostat algorithm constants set forth above are:

| | |
|---|---|
| RATE_LOW_FIRE | 40//Firing Rate |
| RATE_WARMUP | 50//Firing Rate |
| BURNER_TIME_IN_WARMUP | 60//seconds |
| AIR_OFF_DELTA_PERCENT | 30//subtract from demand in . . . RUN_2 |
| AIR_MAX_STAT_ON | 80//Firing Rate |
| AIR_MIN_STAT_ON | 50//Firing Rate |
| AIR_MAX_STAT_OFF | 60//Firing Rate |
| AIR_MIN_STAT_OFF | 40//Firing Rate |
| DEMAND_LIMIT_PERCENT | 17//% update after HF or LF is reached. |
| DEMAND_UPDATE_PERCENT | 3//maximum update per ON/OFF transition. |
| AIR_UPDATE_INTERVAL | (6 * 60)//line cycles (1 second) |

Stoichiometry Control

At least three different examples of stoichiometry control, or modulation, as discussed below, may be employed with this system:

Modulating Output Using Modulated Pressure Feedback Gas Valve

Figure 5:
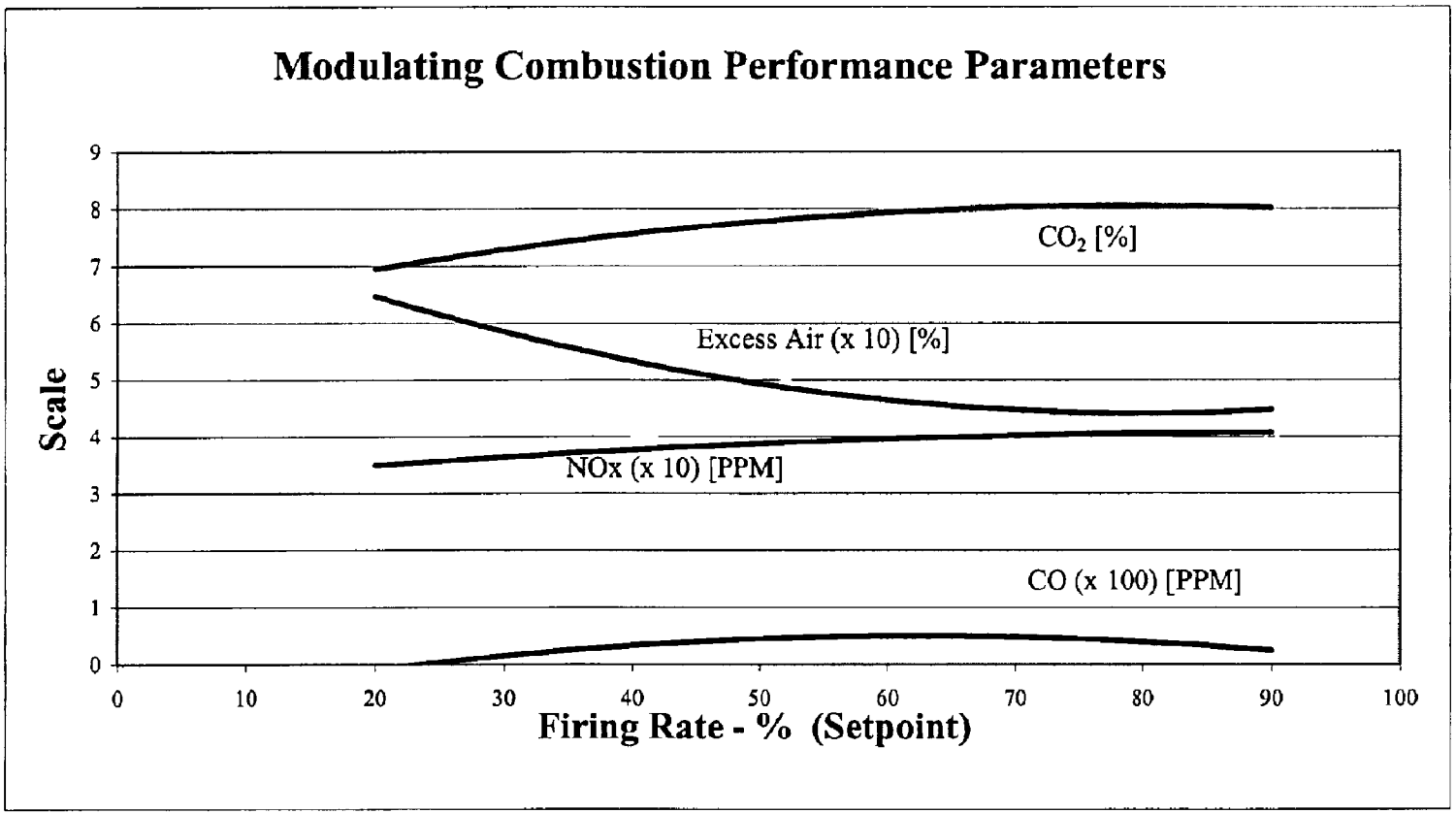
FIG. 5 shows the emission data versus firing rate for the furnace while modulating between a 20% and a 90% firing rate.

The controller 23 may respond to a call for heat by requesting a predetermined firing rate output, e.g., fuel percentage and inducer speed, from the furnace. Based on the desired output, the controller may determine the airflow required from the inducer blower 33 such as by calculation or accessing a lookup table. The speed of the inducer blower fan 33 may be adjusted until the correct pressure (vacuum) is attained. The pressure feedback gas valve 31 (FIG. 2) may automatically track the pressure (vacuum) from the inducer blower 33 so as to achieve the correct stoichiometry. When a different heating output is commanded, the speed of the inducer blower motor 33 may be altered based on the lookup table information and the pressure feedback valve may automatically track and adjust gas flow. FIG. 4 shows the relationship between the combustion blower pressure and the gas valve output pressure. FIG. 5 shows performance data of a burner system operated between 20% to 90% firing rate, and illustrates how the system maintains the correct combustion parameters throughout the operating range.

Modulating Output using Electrically Modulated Gas Valve

The controller may respond to a call for heat by requesting a predetermined firing rate, i.e. fuel, output from the appliance. Based on the desired output, the controller may also determine the airflow required from the inducer blower. The input signal to the electrically modulated valve 31 (FIG. 3) may be set in accordance with the appropriate firing rate value so as to achieve the correct stoichiometry. The speed of the inducer blower fan may be adjusted until the correct pressure is attained. When a different heating output is commanded, the speed of the inducer blower motor as well as the electrically modulated gas valve setting may be altered to achieve the correct stoichiometry at the new firing rate.

Closed loop Combustion Control (CLCC) using Electrically Modulated Gas Valve

Closed Loop Combustion Control provides a means for accurately controlling fuel/air stoichiometry under all operating conditions using a flame rod as a sensor. The flame rod ionization sensor 38 is an electrode. It is made of a conductive material that is capable of withstanding high temperatures and temperature gradients. Hydrocarbon flames conduct electricity because charged species (ions) are formed in the flame. Thus, placing a voltage between the flame sensor 38 and a grounded surface causes a current flow when a flame closes the circuit. The magnitude of the current (sensor signal) is related to the ion concentration in the flame.

Figure 6:
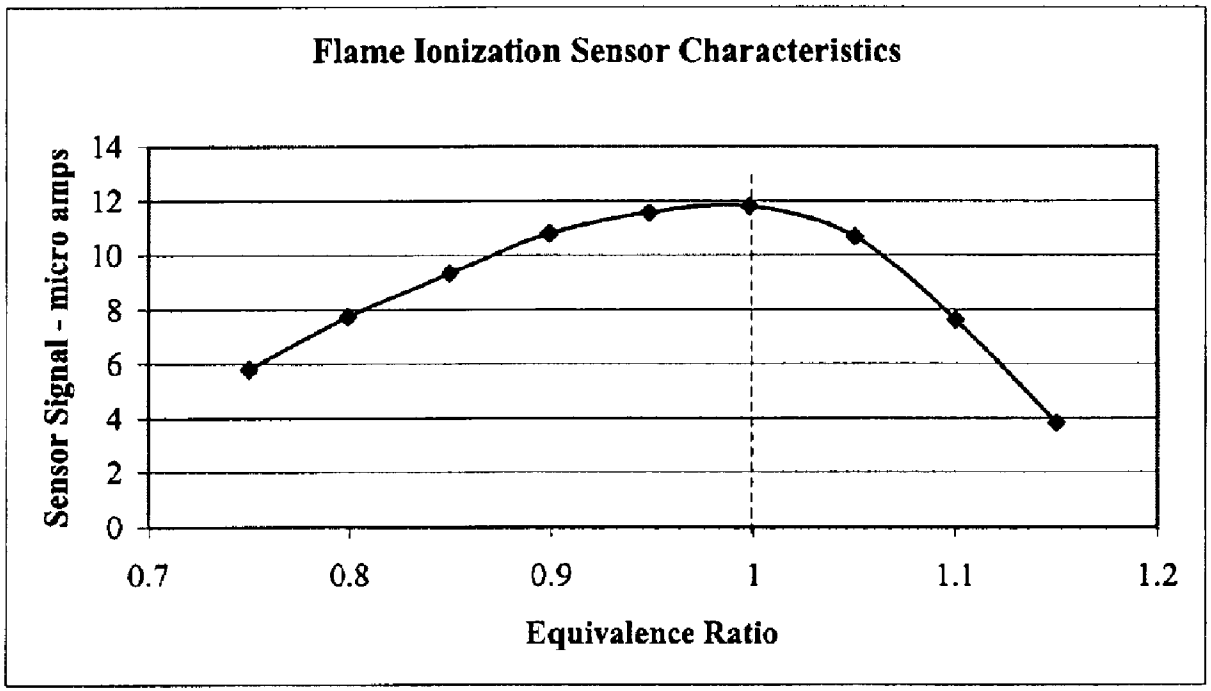
FIG. 6 shows the flame ionization characteristics for a Closed Loop Combustion Controller aspect of the present invention.

In its most basic and common embodiment, the flame sensor 38 is used in the safety circuit to detect the presence or absence of the flame. In a pre-mixed or partial pre-mixed flame, as discussed below, the ion concentration is a strong function of the fuel/air ratio. Since the peak ion concentration occurs near the stoichiometric fuel/air ratio of 1, the ionization current also peaks at this point. Therefore, the peak sensor signal (current) occurs at, or near, the stoichiometric flame condition where the equivalence ratio=1. The peak sensor signal will vary for different fuels, such as propane. FIG. 6 shows a plot of sensor response versus fuel/air ratio in the burner. Using the characteristics of a pre-mixed flame makes possible the monitoring and control of the fuel/air ratio in the flame.

One method to control the fuel/air ratio is to use a "peak seeking" logic controller. Either the fuel or air may be continuously incremented and/or decremented to maintain maximum ion current. This methodology was disclosed in the aforementioned U.S. Pat. No. 5,971,745.

Closed Loop Combustion Control—Partial Pre-Mix Burner Application

Figure 7:
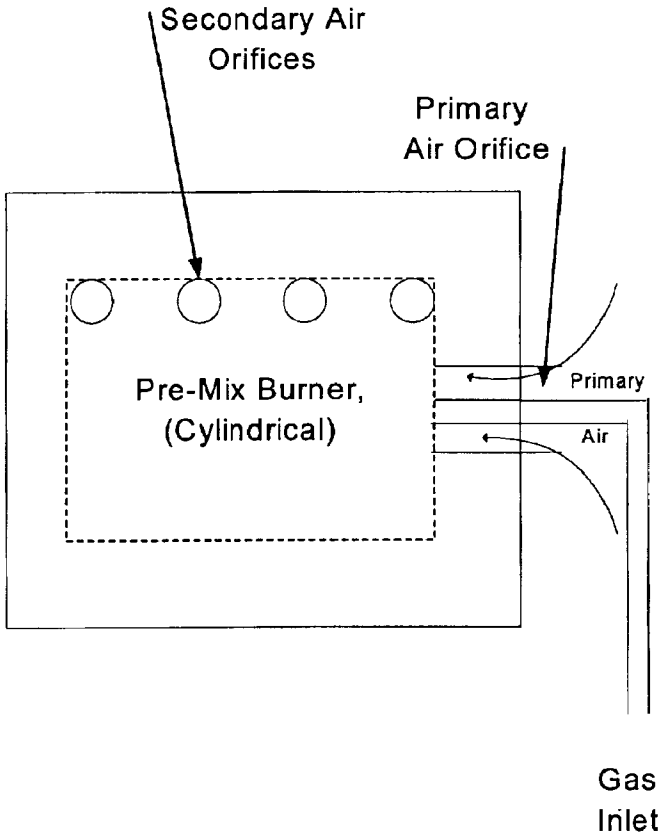
FIGS. 7 shows a front view of the basic construction of a Partial Pre-Mix Burner System as used in some aspects of the invention.
Figure 8:
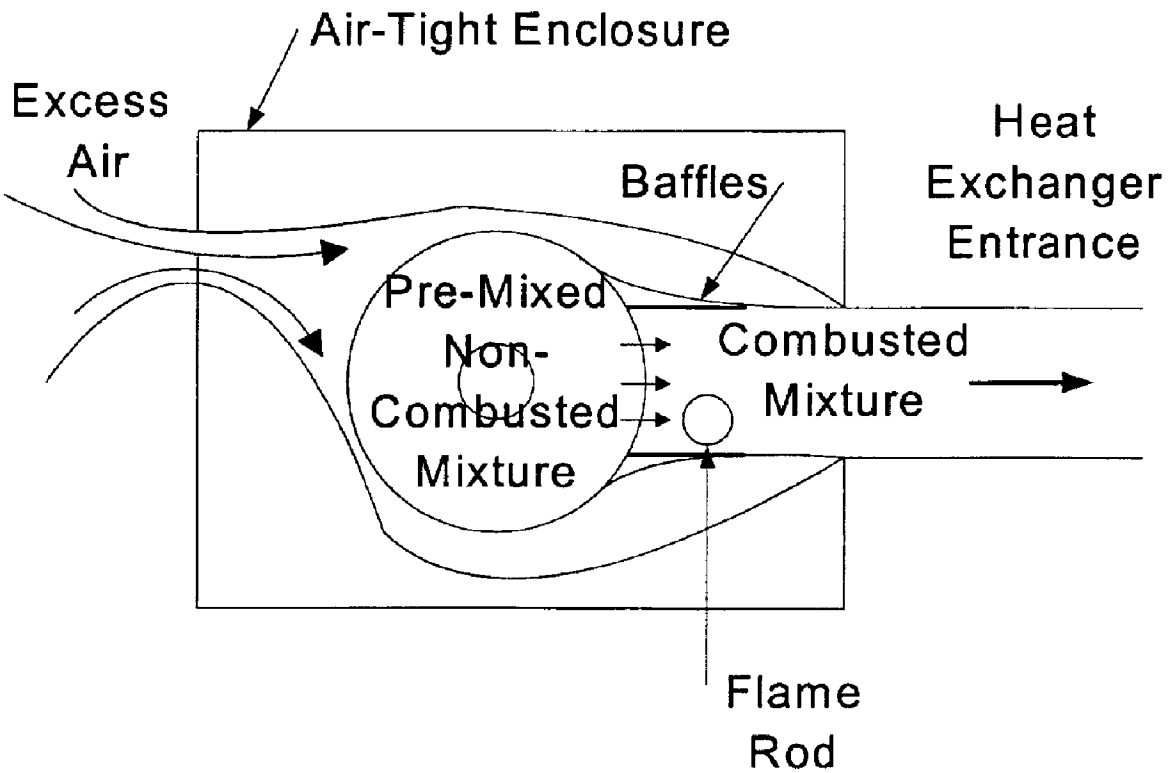
FIGS. 8 shows a side view of the basic construction of a Partial Pre-Mix Burner System as used in some aspects of the invention.

As a further enhancement to the Closed Loop Combustion Control methodology, an alternate burner configuration may be used. For control purposes, it is desirable to operate at the peak of the curve shown in FIG. 6, however, at this condition carbon monoxide may be created. By controlling the pre-mixed fuel/air mixture entering through the gas/air inlet, combustion at this peak condition may be achieved. Secondary air may be introduced (after the initial combustion occurs at an equivalence ratio ~=1), in order to restore the fuel/air mixture to a moderate level of excess air, thereby assuring that all of the hydrocarbons have been consumed. This is achieved by providing a fixed ratio between primary and secondary combustion air based on air control orifice sizes as illustrated in FIGS. 7 and 8. Since the inducer blower 33 may be providing air through both the primary and secondary air orifices simultaneously, the level of excess air in the "blended" combustion gas flow may be maintained at a suitable value. Baffles (FIG. 8) may be used to prevent secondary air from streaming into the pre-mixed combustion zone thus diluting the primary mixture and providing a diffused mixture as opposed to the desired partial premix, thus avoiding interference with the "peak seeking" signal. A representative version of such a pre-mix burner may be obtained from BSI, Burner Systems International, Inc., under the commercial designation SR and Premix Burners.

Referencing the operational states of Table 2 below, the controller 23 conducts certain sequential steps and safety checks according to the described states in order to guarantee safe combustion operation under all operating conditions. Operational states for variable furnace control are maintained by a BURNER_Process subroutine of the controller that is invoked once per line cycle. These operational states provide the basis for all operations. These routines monitor operation in the startup, operational, and shutdown phase of appliance operation. These routines check the performance of the electronic circuits and are fail-safe in the event of single component failures of any type.

TABLE 2

| | Operational States |
|---|---|
| STATE | DESCRIPTION |
| BURNER_STATE_LOCKOUT | This state is entered when all allowed attempts at lightoff have failed. Combustion air, gas, and igniter are set to OFF. The circulation blower is also OFF unless power is absent at the "R" terminal. This state persists for one hour when a reset will be issued. |
| BURNER_STATE_RETRY | This state is entered when an attempt to lightoff has failed. A post-purge will be performed to eliminate any combustible mixture, followed by a retry wait period that may vary as a function of the number of retries attempted. The next state will be BURNER_STATE_LOCKOUT if all retries have been exhausted, otherwise BURNER_STATE_OFF |
| BURNER_STATE_OFF | This state is entered at the end of either a heating or cooling cycle. This state will persist until the next demand for heat, which will result in BURNER_STATE_PURGE; or until the next demand for cooling, which will result in BURNER_STATE_COOL; or until one hour has elapsed which causes a reset to be issued. |
| BURNER_STATE_PURGE | This state is entered to initiate a heating cycle. The purpose of this state is to initiate the pre-purge operation and delay a short time before applying current to the igniter. This state is followed by BURNER_STATE_IGNITION. |
| BURNER_STATE_IGNITION | This state continues the pre-purge operation and begins the controlled warm-up of the igniter. The igniter should be at full temperature at the end of this state that is followed by BURNER_STATE_GAS_ON. |
| BURNER_STATE_GAS_ON | The gas valve is opened during this state allowing the fuel/air mixture to be exposed to the hot igniter. This state persists for a fixed time period at which point the flame detect circuit must indicate presence of a flame to enter BURNER_STATE_WARMUP. If no flame is detected, BURNER_STATE_RETRY is entered. |
| BURNER_STATE_WARMUP | The purpose of this state is to proof the flame at the lightoff rate, then to bring the rate to a predefined level for a warmup period. The warmup period is designed to eliminate condensation therefore, the burn will continue even if there is no demand. BURNER_STATE_RUN will be entered following the warmup period. A flameout condition will initiate the BURNER_STATE_RETRY. |
| BURNER_STATE_RUN | This state is characterized by operation at the modulation rate called for by the demand algorithm. The state will persist until the call for heat is satisfied. The state will then transition to BURNER_STATE_RUN_2. A flameout condition in this state will not result in a retry. |
| BURNER_STATE_RUN_2 | This state is characterized by continued operation at an algorithm determined modulation rate while a "thermostat ON" signal is absent. If the "thermostat ON" signal becomes active, the state will be set to BURNER_STATE_RUN. The state will be set to BURNER_STATE_OFF if the algorithm determines that the modulation should fall below the Low Fire value. A flameout condition in this state will not result in a retry. |
| BURNER_STATE_COOL | This state is entered when there is a call for cooling as indicated by the "cooling" terminal. It will persist until the call for cooling has been satisfied which causes a transition to BURNER_STATE_COOL_2. The "high cool to condensor" output is energized COOLING_TIME_IN_LOW after this state is entered. |
| BURNER_STATE_COOL_2 | This state is entered after the call for cooling has been satisfied. It will persist for the period BURNER_TIME_IN_AC_OFF (e.g. about 6 |

TABLE 2-continued

| STATE | Operational States DESCRIPTION |
|---|---|
| | min.) followed by a transition to BURNER_STATE_OFF |

A variable speed air circulator motor 43, such as the aforementioned shaded pole or PSC AC induction motors, according to some aspects of the invention, may be controlled through a wide speed range so as to maintain a desired discharge air temperature or flow for the conditioned air. The basic control circuits are the subject of the previously mentioned U.S. Pat. No. 6,329,783 and co-pending patent application Ser. No. 10/191,975. To control the discharge air temperature to the conditioned space, a discharge air temperature sensor 53 may be located within the air stream downstream of the heat exchangers, e.g., either the furnace heat exchanger 25 or the air conditioning coil 55, or both. After a call for heating or cooling, the circulator motor 43 is activated. Once in operation, the motor speed may be controlled to reach and maintain discharge air temperatures within a specified temperature band, say 120° F. to 140° F., regardless of the firing rate of the burner. At the end of the heating cycle the circulator motor 43 may continue to run until a preset temperature, of say 90° F. is reached, at which time the circulator motor 43 may be shut off. A preset delay time could also be used as criteria for circulator motor turnoff.

In some cases it may be desirable to use a constant airflow algorithm to control the circulator motor in order to maintain the duct airflow constant under different operating conditions, such as in zoning applications where dampers are frequently opened or closed. As an option, the constant airflow algorithm may be provided in the controller 23. This algorithm is described in co-pending U.S. patent application Ser. No. 09/904,428, entitled "Constant CFM Control Algorithm for an Air Moving System Utilizing a Centrifugal Blower Driven by an Induction Motor."

In some cases it may be desirable to use constant pressure to control the circulator in order to maintain the duct air pressure constant under varying conditions, such as zoning applications where dampers are frequently opened or closed. As an option, the constant pressure algorithm may be provided. This application is described in the aforementioned co-pending U.S. patent application Ser. No. 10/191,975, entitled "Variable Speed Controller For Air Moving Applications Using An AC Induction Motor".

A temperature sensor option may be applied with the circulator motor speed control as shown in FIGS. 2 and 3. In many applications such as furnaces and air conditioners, the discharge air temperature needs to be maintained within a suitable range. In heating applications, this may be to assure proper temperatures so as to avoid cold drafts. In cooling applications, it may be used to control latent heat removal or to avoid coil freeze-up. In these applications, the temperature sensor 53 is used as a controller input to vary the motor speed to maintain temperature within a specified range. In other applications, such as water heating, the temperature sensor may be used to limit the firing rate when a particular condition is achieved.

Circulator Algorithm

Through the use of a temperature sensor 53 located downstream of the heating or cooling coil 55, the speed of the circulator fan 43 may be controlled so as to maintain a set discharge temperature.

In the heating mode the fan speed is operated at a speed that:

1. Generally maintains the discharge temperature within a set temperature band, e.g., 120° F. to 140° F.
2. Limits the high discharge temperature if this condition occurs.
3. Decreases fan speed at a point where condensation might occur in the primary heat exchanger.

Cooling Algorithm

A single stage thermostat, or other sensing device, and a thermostat algorithm can be used on the cooling cycle as well as the heating cycle. This algorithm may operate a single, multi-stage, or modulatable compressor in a manner so as to determine a demand load for the system and maintain proper conditioned space temperatures. Through the use of a temperature sensor, e.g. 53, located downstream of the cooling coil 55, the speed of the circulator fan 43 may be controlled so as to maintain a set discharge temperature. The temperature set point of the temperature sensor 53 for activating the controller 23 may be adjusted so as to regulate the humidity of the discharge air. Higher fan speeds result in decreased moisture (latent heat) removal, while lower fan speeds result in more moisture removal. The temperature sensor 53 can also be used to control minimum fan speed so as to avoid coil freeze up or excess condensation because of low air flow conditions.

A system has been shown whereby a controller provides an inexpensive means for operating a variable output fluid conditioning appliance system, e.g., heating or cooling equipment for gases or liquids, through the use of a series of variable output components and economical sensing and control systems. It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

We claim:

1. A variable output heating system comprising:

a) a variable speed combustion blower;

b) a variable fuel supply valve;

c) a variable speed circulator;

d) a pressure sensor to measure a pressure produced by the variable speed combustion blower;

e) a controller having input from the pressure sensor and outputs for at least the variable elements of a) and c) above, the controller including:

i. a thermostat algorithm for determining a desired firing rate, ii. a lookup table or equation accessible to determine a desired differential pressure of the variable speed combustion blower for the desired firing rate stoichiometry, iii. means for adjusting the variable speed combustion blower speed in order to achieve the desired differential pressure, and iv. means for adjusting the variable speed circulator so as to maintain a circulation according to one of a temperature criterion, a flow criterion and a pressure criterion.

2. The variable output heating system of claim 1 further comprising: means for modulating the variable fuel supply valve to achieve the desired firing rate stoichiometry.

3. The variable output heating system of claim 1 further comprising: the controller having means for controlling all equipment operation sequencing.

4. A variable output heating system comprising:

a) a variable speed combustion fan;

b) a variable fuel supply gas valve;

c) a variable speed air circulator fan;

d) a pressure sensor to measure a pressure produced by the variable speed combustion fan;

e) a discharge air temperature sensor located downstream of a heat exchanger served by the variable speed circulator fan; and f) a controller having inputs from sensor elements d) and e) above and outputs for the variable elements of a) and c) above, the controller including:

i. a thermostat algorithm for determining a desired firing rate, ii. a lookup table or equation accessible to determine a desired differential pressure of the variable speed combustion fan for the desired firing rate, iii. means for adjusting the variable speed combustion fan motor speed in order to achieve the desired differential pressure, and iv. means for adjusting the variable speed circulator fan so as to maintain an air discharge according to one of a temperature criterion, a pressure criterion, or an airflow criterion.

5. The variable output heating system of claim 4 further comprising: the controller having sensing and control means for the variable element b).

6. The variable output heating system of claim 4 further comprising: the controller having means for controlling all combustion operation sequencing.

7. A controller for a variable output heating or cooling system comprising:

a) means for accepting an input from at least one sensor element monitoring a variable element of the variable heating or cooling system, b) means for operating at least one variable element of the variable heating or cooling system, the means for operating including:

i. a thermostat algorithm for determining a desired firing rate of a burner;

ii. a lookup table or equation accessible to determine a desired pressure from operation of a variable speed combustion fan suitable for the desired firing rate, and iii. sensing and control means for controlling the combustion fan speed in order to achieve the desired pressure; and c) wherein the desired pressure is a desired differential pressure across a heat exchanger of the burner.

8. The controller of claim 7 wherein the thermostat algorithm further includes means for determining a desired duty cycle of burner operation.

9. The controller of claim 7 further including sensing and control means for controlling a variable speed circulator.

* * * * *